United States Patent [19]

Koppers et al.

[11] 4,440,526

[45] Apr. 3, 1984

[54] ROCK ANCHORING ARRANGEMENT

[75] Inventors: Manfred Koppers, Duisburg; Karlheinz Bohnes, Bochum; Bernhard Stephan, Gelsenkirchen, all of Fed. Rep. of Germany

[73] Assignee: Bochumer Eisenhütte Heintzmann GmbH & Co., Bochum, Fed. Rep. of Germany

[21] Appl. No.: 332,358

[22] Filed: Dec. 18, 1981

[30] Foreign Application Priority Data

Dec. 18, 1980 [DE] Fed. Rep. of Germany ..... 3047709

[51] Int. Cl.[3] ..... E21D 21/00

[52] U.S. Cl. ..... 405/260; 411/9

[58] Field of Search ..... 405/259, 260, 261, 262; 411/8, 9, 56, 82

[56] References Cited

U.S. PATENT DOCUMENTS 3,460,429 8/1969 Torre ..... 411/56 X 4,313,695 2/1982 McCartney ..... 405/259

FOREIGN PATENT DOCUMENTS 1434225 2/1966 France ..... 405/260

*Primary Examiner*—David H. Corbin

*Attorney, Agent, or Firm*—Michael J. Striker

[57] ABSTRACT

A rock anchoring arrangement for use especially in tunnel and mine constructions involving considerable convergences comprises an anchoring sleeve having a leading and a trailing end as considered in the direction of introduction of the anchoring arrangement into an anchoring bore in the rock formation, an anchoring rod having a trailing end portion passing through the interior of the anchoring sleeve and a leading end portion which extends beyond the leading end of the sleeve, a mounting plate arranged at the trailing end of the sleeve and engaging the rock formation around the open end of the bore, and a drawing die secured to the sleeve at the leading end. The anchoring sleeve and the anchoring rod are both retained in the bore by a body of a hardenable material, such as an adhesive, in which the sleeve and the leading end portion of the rod are embedded. The leading end portion of the rod has a smaller diameter than the trailing end portion so that a transition region exists between these portions. The drawing die has an aperture which receives the leading end portion and, when pulling force acts on the arrangement, acts on the transition region to deform the same when the magnitude of the pulling force is at a predetermined level and thus to increase the axial length of the anchoring rod. The aperture is either conical throughout, or includes alternating conical and cylindrical zones.

21 Claims, 6 Drawing Figures

ROCK ANCHORING ARRANGEMENT

BACKGROUND OF THE INVENTION

The present invention relates to an anchoring arrangement in general, and more particularly to a rock anchoring arrangement for use in tunnel, mine, and similar underground constructions, especially such which are subjected to considerable convergences.

Rock anchoring arrangements which have hitherto been used in tunnel and mine constructions have a limited extensibility of no more than approximately 15%. This means, generally speaking, that they can only be employed in situations where only relatively slight movements of the rock strata can be expected. As a result of the advancement into steadily increasing depths, and as a result of the attendant proportionately increasing convergences, there exists, in practice, a need for the provision of rock anchors which would render it possible to keep the rock under control, even when the movement of the strata is substantial.

One conventional rock anchor of this general type is disclosed on page 5 of the issue No. 105 of Kurznachrichten, published by Steinkohlenbergbauverein in December 1979. This rock anchor for substantial convergences comprises an anchoring rod which is adhesively secured within a steel pipe that is filled with a synthetic resin mortar. At the inner or leading end of the anchoring rod, as considered in the direction of introduction of the rock anchor into the associated bore in the rock formation, there are provided radially extending protuberances which are being pulled through the adhesive which secures the anchoring rod in the anchoring sleeve or pipe as the anchoring rod is loaded in its longitudinal direction. Thus, the adhesive, which consists of a synthetic resin material, forms a severable lining. The force required for pulling the protuberances through the severable lining determines the resistance of the rock anchoring arrangement to extension. The inner or leading end of the anchoring rod, which carries the protuberances, has a diameter which is reduced relative to the remainder of the anchoring rod, to present a possibility for the particles or chips of the material detached from the severable lining by the protuberances to escape from the space between the anchoring rod and the anchoring sleeve, so that they do not become packed ahead of the protuberances and either increase the resistance of the anchoring arrangement to further extension of elongation, or widen the sleeve, or both.

In view of the necessary strength of the protuberances and their being embedded in the anchoring rod, however, only a very limited escape gap can be provided between the anchoring rod and the anchoring sleeve. As a result of this, the particles, slivers or chips of the severed material which are detached from the anchoring sleeve by the action of the protuberances on the severable lining must pass through this relatively narrow gap. This results in a blocking action at the severable lining, which becomes progressively worse with increasing speed of displacement. Eventually, this may result in a situation where the force needed for extending the anchoring arrangement substantially exceeds that originally contemplated, which may result in the destruction of the anchoring arrangement.

In addition to the afore-mentioned disadvantage of non-uniform extension force, and the disadvantage of high consumption of material, which is attributable to the substantial axial length of the anchoring sleeve and the considerable axial length of the anchoring rod which carries the severing protrusions, there are present, in this conventional anchoring arrangement, further disadvantages which considerably limit the usability of the conventional rock anchoring arrangement in practical applications.

If the anchoring sleeve were to be adhesively secured, for instance, at the bottom region of the bore provided therefor in the rock formation, it would be necessary or even mandatory to give the bore a substantial diameter. There also exists the possibility that, in the event of rock shift transversely of the elongation of the anchoring arrangement, the anchoring rod would be pulled out from the anchoring sleeve, whereby the effective extension path of the rock anchor arrangement in its longitudinal direction is diminished. Moreover, it would only make sense to fix the rock anchor in the bore via its anchoring sleeve. If the anchoring rod were also adhesively attached, the lengthening effect of the anchoring arrangement, which is desired in order for the rock anchoring arrangement to be able to adapt itself to considerable convergences, would be defeated. In this case, there would then be obtained only a rock anchoring arrangement conforming to the initially disclosed rock anchoring arrangement which is used in constructions involving only slight movements of the strata.

On the other hand, should the anchoring sleeve be adhesively attached at the region of the open end of the bore, the anchoring sleeve would have to be equipped with an additional anchoring extension reaching to the bottom of the bore. Though such a construction would avoid the disadvantage of having to maintain a relatively large bore diameter all the way to the bottom of the bore because it could then be drilled in steps, in this instance the distance between the open end of the bore and the anchoring sleeve would increase upon loading of the rock anchoring arrangement, because the anchoring sleeve would travel into the rock formation. In addition thereto, rock or adhesive mortar would be displaced by the anchoring sleeve during the process. The necessary force transmitted as a result thereof from the anchoring sleeve to the anchoring rod depends on the solidity of the rock and/or the strength of the adhesive mortar. Since this force cannot be determined accurately and, accordingly, can grow higher than the desired extension force, there exists the risk that the adhesively attached anchoring rod could break before the desired extension force was even reached. In this manner, the very reason for providing the rock anchoring arrangement, that is, to hold the rock in place, would be defeated.

SUMMARY OF THE INVENTION

Accordingly, it is a general object of the present invention to avoid the disadvantages of the prior art.

More particularly, it is an object of the invention to provide a rock anchoring arrangement which is not possessed of the disadvantages of the conventional arrangements of this type.

It is still another object of the present invention to so construct the arrangement of the type here under consideration as to obtain a desired change in length thereof at a predetermined, preferably substantially constant, pulling force, regardless of the length extension already suffered and the speed of the length change.

A concomitant object of the invention is to so design the anchoring arrangement as to be simple in construction, inexpensive to manufacture, easy to install, and reliable nevertheless.

In pursuance of these objects and others which will become apparent hereafter, one feature of the present invention resides, briefly stated, in an anchoring arrangement adapted to be inserted into and held by a body of hardenable material in a bore provided in a support structure, especially in a rock formation encountered in tunnel and mine construction, particularly such involving a considerable convergence, the anchoring arrangement comprising a sleeve having a leading and a trailing end as considered in the direction of insertion thereof into the bore; a mounting plate arranged at the trailing end of the sleeve and adapted to contact the rock formation around the bore; an elongated anchoring rod having a trailing end portion at least partially accommodated within the sleeve and having a larger cross-sectional area and a leading end portion of a smaller cross-sectional area extending beyond the leading end of the sleeve into the bore; and at least one drawing die secured to the sleeve at the leading end and having an aperture of a cross-sectional configuration corresponding to that of the anchoring rod at the transition region between the leading and trailing portions of the anchoring rod.

A particular advantage of this construction of the anchoring arrangement is that, when movement of the rock strata or formation occurs in the direction of the longitudinal axis of the anchoring rod, the drawing die or ring which is secured in position in the anchoring sleeve is drawn by the action of the anchoring or mounting plate and of the anchoring sleeve thereon, starting at the converging or tapering transition region, longitudinally of the trailing portion of the anchoring rod which has the larger diameter and which freely extends through the interior of the anchoring sleeve in the longitudinal direction of the anchoring arrangement, while the reduced-diameter longitudinal leading portion of the anchoring rod is adhesively secured in position in the bore provided in the rock formation, so that the initial cross-sectional area of the trailing portion of the anchoring rod is thereby reduced to a cross-sectional area which is smaller than the initial cross-sectional area. Final cross-sectional areas which are up to 40% smaller than the initial cross-sectional area of the trailing portion of the anchoring rod can be obtained without difficulty.

An important advantage of the construction according to the invention resides in the fact that the initial length of the anchoring rod can be substantially shorter than the path of extraction, due to the reduction of the cross-sectional area. The pulling force required for the deformation of the anchoring rod is always constant, after the static friction has been overcome. Even the drawing or extension speed does not bring about a noticeable change in the pulling force. The characteristic behavior of the rock anchoring arrangement is thus independent of the properties and deformations of the surrounding rock. The characteristic curve has a steep initial load gradient, resulting in an early bearing capacity and, after reaching the desired load, the anchoring arrangement has a great resiliency with a constant load absorption. The resiliency is determined, generally speaking, by the length of the anchoring rod trailing portion which extends freely through the anchoring sleeve. The relatively slim construction of the rock anchoring arrangement of the invention renders it feasible to introduce and fix anchoring rods and anchoring sleeves in a bores of a reletively small diameter. The rock anchoring arrangement is insensitive to shocks or mishandling, such as during transportation, and is functionally reliable.

The transition region between the two longitudinal portions of the anchoring rod which have different diameters depending on whether situated within or without the anchoring sleeve can be designed differently. A preferred solution according to the invention resides in that the tapering or converging region is slightly conical. With a given pulling force, the transverse force which determines the outside diameter of the drawing die and thus the diameter of the leading portion of the anchoring rod, is dependent on the angle of inclination of the cone with respect to the longitudinal axis of the anchoring rod, and on the yieldability of the material of the anchoring rod.

An advantageous feature of the invention which affects the degree of slimness of the rock anchoring arrangement is that the conical surface of the taper extends at an angle of about 3° to 10° relative to the longitudinal axis of the anchoring rod. The conical surface of the tapering transition region extends at an angle of about 7° to the longitudinal axis of the anchoring rod.

The tapering transition of the anchoring rod and, accordingly also the aperture in the drawing die, by means of which the anchoring rod is deformed, that is, cross-sectionally reduced and longitudinally extended, can comprise one single step. However, it is more advantageous when the aperture in the drawing die has at least two steps. The greater the number of deformation steps, the slimmer can the rock anchoring arrangement be at the deformation region. When there is only one deformation stage, the entire transverse force acts only upon a relatively small region of the drawing die, so that the drawing die or ring must absorb all transverse forces at one place, so that its outside diameter must be dimensioned accordingly. When the aperture in the drawing die has several steps, the transverse forces act simultaneously at a number of places. The transition region at which the transverse forces act is therefore larger so that the outside diameter of the drawing die can be kept smaller.

In this connection, an advantageous feature of the invention, which represents a further development, is that the steps of the drawing die are constituted by conical and cylindrical longitudinal zones, which axially alternate with one another. The conical longitudinal zones have the same angle of inclination relative to the longitudinal axis of the anchoring rod. As a result of the provision of the cylindrical longitudinal zones axially flanking the conical longitudinal zones, the diameter of the drawing die can be kept to a minimum. Of course, this will result in an increase of the axial length of the drawing die, but it also results in a smaller diameter of the anchoring bore.

As has been explained before, the drawing die, whether it has only one step or a plurality of steps, can be of one piece. According to the invention, however, it is advantageous when, in addition to the drawing die, at least one further drawing die is fixed in the anchoring sleeve, the aperture of the further drawing die being stepped relative to the aperture of the first drawing die. Even in this case, the aperture in each drawing die may be formed by cylindrical and conical zones, preferably by cylindrical longitudinal end zones and an intermediate conical longitudinal zone, so that each drawing die constitutes a separate deformation stage. Like in the case of the one-piece drawing die, a conical longitudinal zone is interposed between two cylindrical longitudinal zones when there are two or more immediately axially succesive drawing dies, so that the diameter of each individual drawing die can be kept relatively small and the entire rock anchoring arrangement thereby obtains a slim configuration.

According to a further advantageous feature of the invention the drawing die is, or the drawing dies are, pressed into the anchoring sleeve to be engaged by a lip provided at the leading end of the anchoring sleeve. The drawing die is, or the drawing dies are, first pressed into the leading end portion of the anchoring sleeve, which brings about an advantageous redistribution of the radial and axial forces in the drawing die or dies. The free edge of the anchoring sleeve which originally projects beyond the drawing die or dies is then pressed inwardly so that the drawing die or dies cannot be extracted from the anchoring sleeve by the pulling force acting on the anchoring rod.

At the region of the lip there is provided in a suitable manner a seal which may consist of a synthetic plastic material and may be shaped as a ring, according to the invention. This seal, which is secured in position by means of the lip, successfully prevents the originally pourable adhesive from flowing between the drawing dies and the anchoring rod as the anchoring rod is being adhesively attached, or pit water from penetrating into this region.

According to the invention, it is also advantageous when that end of the anchoring sleeve which projects from the anchoring bore is outwardly flanged or upset and the flange is provided with key or eccentric faces. In addition to the fact that the flange performs the task of holding the anchoring or mounting plate, the anchoring sleeve can thus be turned during the adhesive attaching operation via the flange, that is, by way of the key faces provided on the flange. In this connection, it is of advantage when even the free end of the anchoring rod, that is, the leading portion which projects from the anchoring sleeve, is provided with key faces. In this manner, both the anchoring rod and the anchoring sleeve can be turned simultaneously during the adhesive attaching operation and the components of the two-component adhesive can be thus sufficiently mixed.

According to the invention, it is also advisable when the reduced diameter longitudinal leading portion of the anchoring rod which, in use, projects beyond the leading end of the anchoring sleeve into the anchoring bore, is undulatingly deformed in at least one longitudinal plane. This deformation brings about an alignment of the anchoring rod with respect to the longitudinal axis of the anchoring bore. Moreover, the adhesive components are thoroughly mixed. A further advantage of the undulating anchoring rod is that the anchoring rod has a particularly high yieldability to compensate for rock displacements transversely to the longitudinal axis of the anchoring rod.

Finally, one feature of the invention resides in that the reduced-diameter longitudinal leading portion of the anchoring rod is provided with a helically extending, circumferential ridge. This ridge also effects, in addition to the undulation of the reduced-diameter longitudinal leading portion of the anchoring rod, a thorough mixing of the adhesive components and thus ensures a satisfactory adhesive retention of the rock anchoring arrangement in the bore. On the other hand, its previous capability of elongation in the event of great convergences is not adversely affected thereby.

The novel features which are considered as characteristic of the invention are set forth in particular in the appended claims. The improved anchoring arrangement itself, however, both as to its construction and its mode of operation, together with additional features and advantages thereof, will be best understood upon perusal of the following detailed description of certain specific embodiments with reference to the accompanying drawing.

DESCRIPTION OF THE PREFERED EMBODIMENTS

Figure 1:
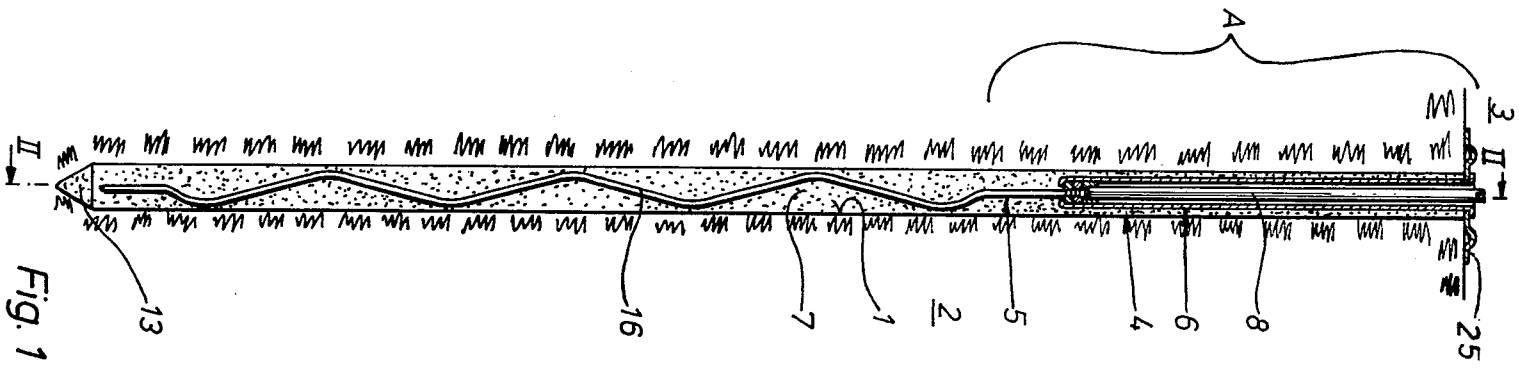
FIG. 1 is a longitudinal sectional view of an anchoring bore and of a rock anchoring arrangement of the present invention fixed therein.
Figure 2:
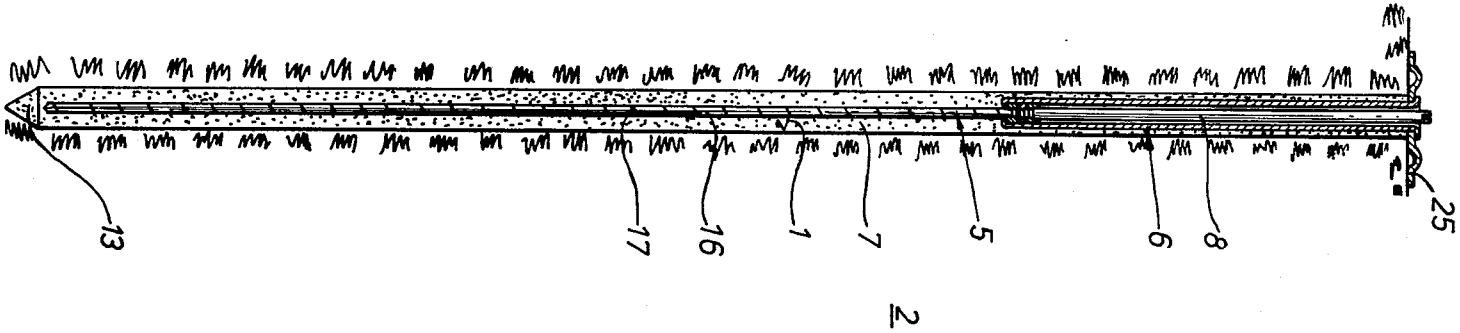
FIG. 2 is a longitudinal sectional view taken along line II—II of FIG. 1.

Referring now to the drawing in detail, and first to FIGS. 1 and 2 thereof, it may be seen that the reference numeral 1 has been used to identify an anchoring bore which has been provided, for example, in a working face 2 of a gallery 3 of an underground coal mine.

A rock anchoring arrangement 4 is fitted into and fixed in the bore 1. The rock anchoring arrangement 4 comprises an anchoring rod 5 and an anchoring sleeve 6 through which the anchoring rod 5 extends in longitudinal direction and which is fixed in the anchoring bore 1 by means of a two-component adhesive 7. The anchoring rod 5 itself is, in turn, fixed in the anchoring sleeve 6. The manner in which this is done will be explained hereinafter.

Figure 3:
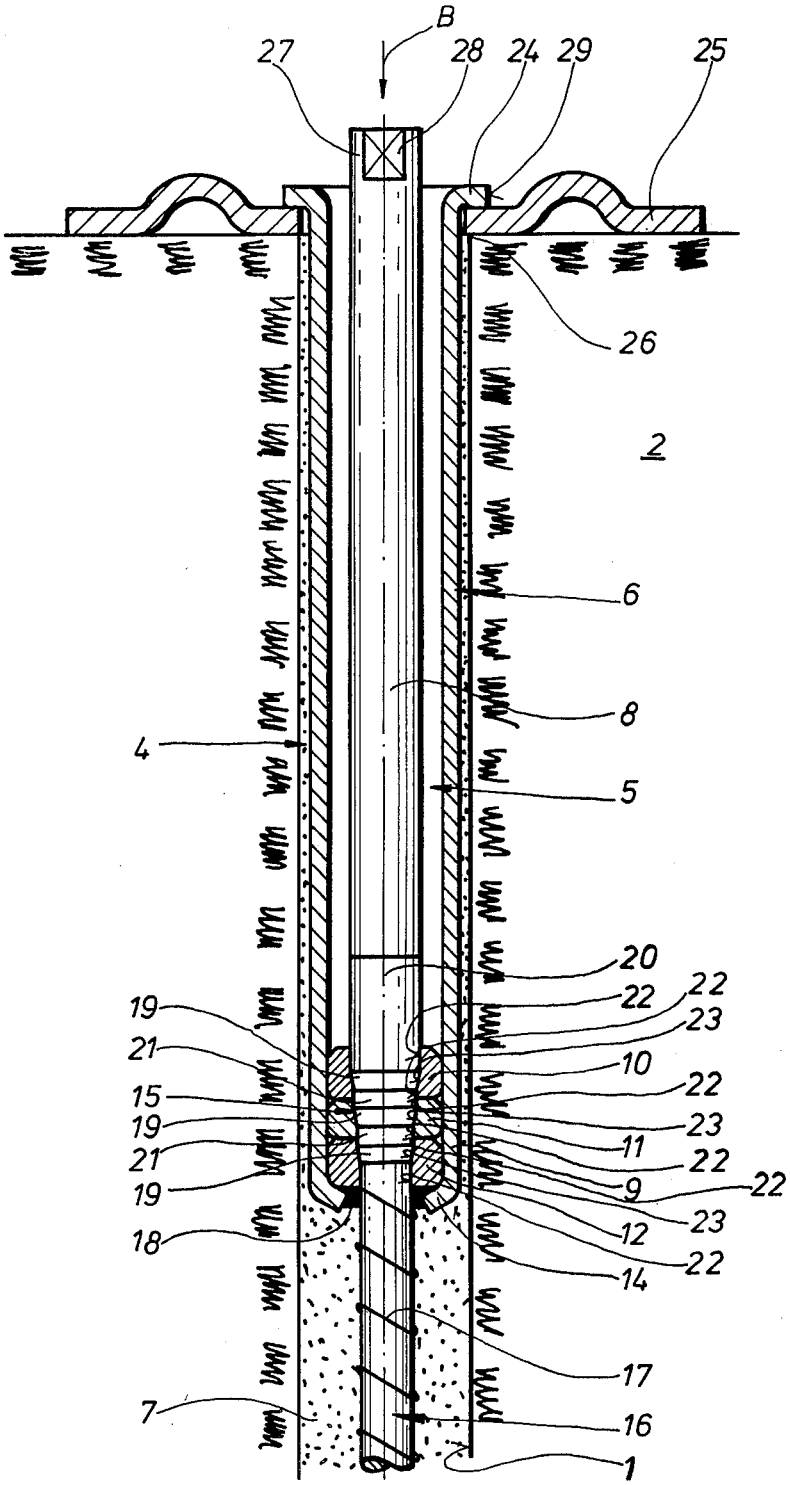
FIG. 3 is a view corresponding to FIG. 1 but showing a region A on an enlarged scale.

As will be seen more clearly in FIG. 3, an anchoring rod 5 is used which comprises a substantially smooth, straight cylindrical longitudinal trailing portion 8 which extends freely and centrally through the anchoring sleeve 6. Three drawing die elements 10, 11, 12, of annular configurations are pressed in at a leading end 9 of the anchoring sleeve 6. The drawing die element 12 which lies closest to the bottom 13 of the bore 1 engages with a lip 14 of the anchoring sleeve 6.

The cylindrical longitudinal trailing portion 8 is adjoined by a tapering transition region 15 which merges into a longitudinal leading portion 16 of the anchoring rod 5, the leading portion 15 having a smaller diameter than the trailing portion 8. As can be seen in FIGS. 1 to 3, the longitudinal leading portion 16 undulates in a longitudinal plane. It also has a helically extending, circumferential ridge 17. A sealing ring 18 of synthetic plastic material is fitted in front of the drawing die element 12 onto the diametrically reduced longitudinal leading portion 16 and is sealingly fixed in the sleeve 6 by compression, by means of the lip 14.

In the embodiment according to FIG. 3, the tapering transition region 15 comprises in all three conical longitudinal zones 19 of which each has the same angle of inclination to the longitudinal axis 20 of the anchoring rod 5. Cylindrical longitudinal zones 21 are located between the conical longitudinal zones 19 of the tapering transition region 15. In correspondence with these cylindrical zones 21 and conical zones 19, cylindrical longitudinal zones 22 and conical longitudinal zones 23, which match the respective portions 19, 21 of the tapering transition region 15, are provided in the three drawing die elements 10, 11, 12. The angle of inclination of the conical zones 19 and 23 of the tapering transition region 15, or of the drawing die element 10, 11, 12, is, for example, 7.1° relative to the longitudinal axis 20 of the anchoring rod 5.

As can also be seen in FIGS. 1 to 3, the diametrically reduced longitudinal leading portion 16 of the anchoring rod 5 and the anchoring sleeve 6 are fixed in the anchoring bore 1 by means of a two-component adhesive 7.

A free trailing end 24 of the anchoring sleeve 6 is flanged or upset outwardly at approximately right angles. This flange 24 retains an anchoring plate 25 in position at the circumference of an open end 26 of the bore 1 which opens onto the working face 2.

Figure 4:
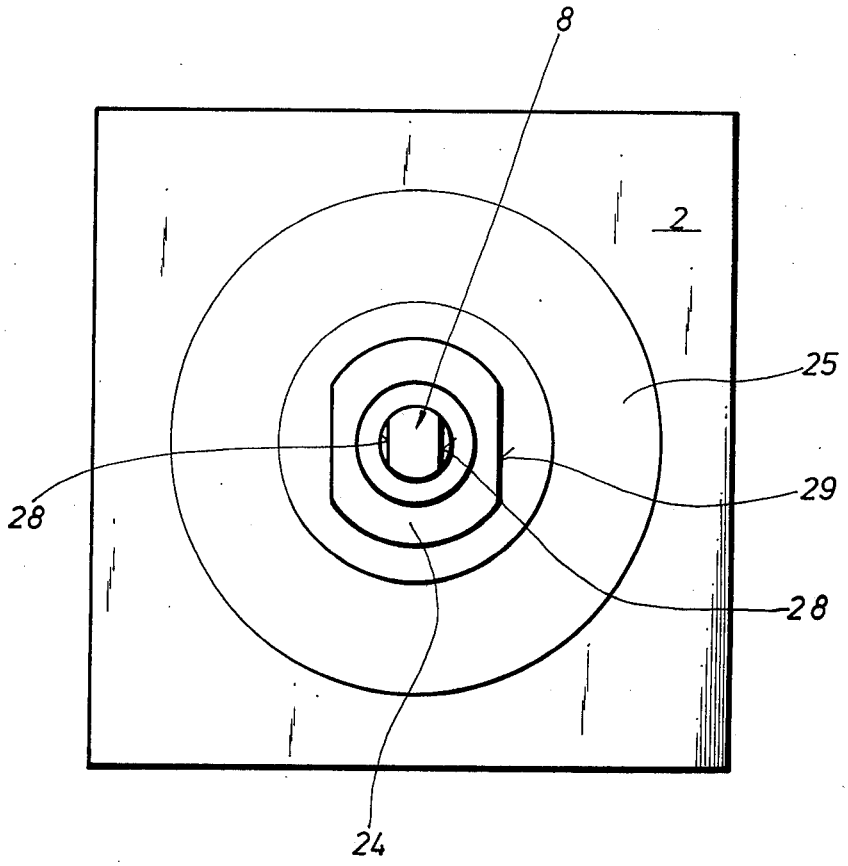
FIG. 4 is an end view of the rock anchoring arrangement taken in the direction of an arrow B in FIG. 3.

A free end 27 of the cylindrical longitudinal trailing portion 8 which has the larger diameter projects beyond the anchoring sleeve 6 and is provided with key faces 28. Referring to FIG. 4 in this connection, it may be seen there that the flange 24 of the anchoring sleeve 6 is also provided with key faces 29. In this manner the anchoring rod 5 and the anchoring sleeve 6 can be simultaneously turned when the rock anchor 4 is fitted into the anchoring bore 1 and the two-component adhesive 7 can be thoroughly mixed thereby to ensure a reliable adhesion of the anchoring arrangement 4 in the bore 1.

Figure 5:
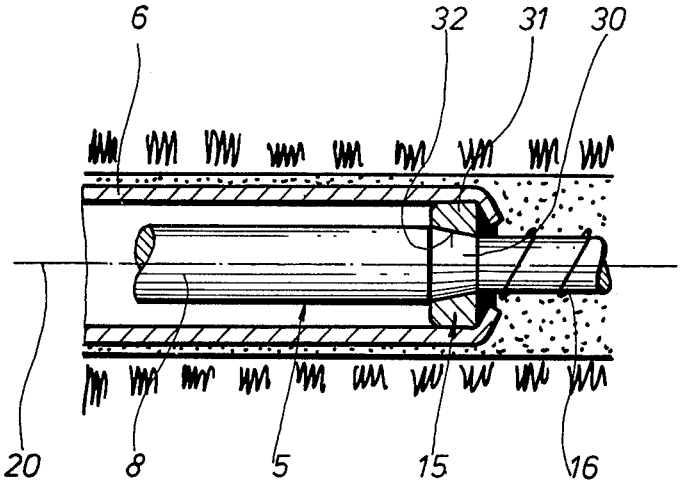
FIG. 5 is a view similar to FIG. 3 but showing an anchoring sleeve including a drawing die provided with only one deformation stage.

FIG. 5 shows an embodiment in which the tapered region 15 of the anchoring rod 5 comprises only one deformation stage at the transition region between the longitudinal trailing portion 8 of a larger diameter and the diametrically reduced longitudinal leading portion 16 having a smaller diameter than the trailing portion 8. There is provided only one conical longitudinal zone 30. Accordingly, there is only one drawing die 31 provided with an aperture 32, the aperture 32 corresponding to this transition region 30.

Figure 6:
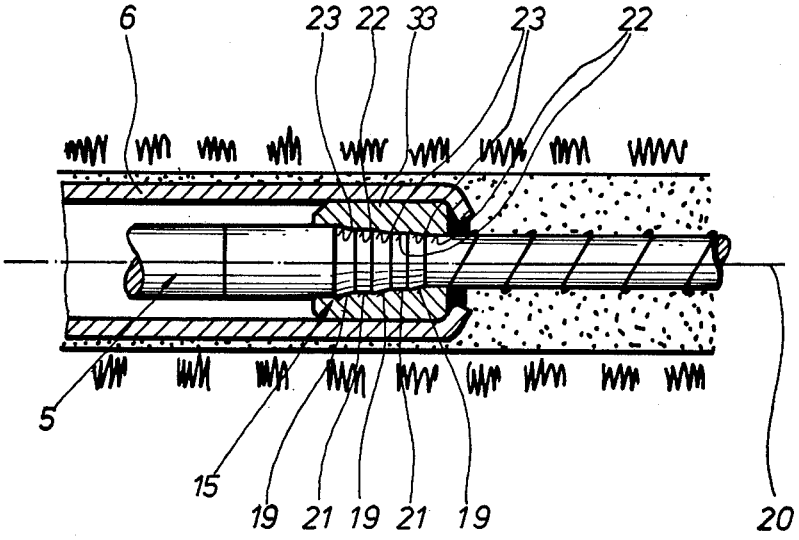
FIG. 6 is a view similar to FIG. 5 but showing an anchoring sleeve including a drawing die having three deformation stages.

In the embodiment according to FIG. 6 there is also provided only one drawing die 33. However, this drawing die 33 has three deformation stages like the construction depicted in FIG. 3. That is, conical longitudinal zones 23 alternate with cylindrical longitudinal zones 22 in the drawing die 33. Corresponding longitudinal portions 19, 21 are then also present in the tapering transition region 15.

The conical surfaces of the deformation stages of the embodiments of FIGS. 5 and 6 also extend at an angle of about 7° to the longitidinal axis 20 of the anchoring rod 5.

It will be understood that each of the elements described above, or two or more together, may also find a useful application in other types of arrangements differing from the type described above.

While the invention has been illustrated and described as embodied in an anchoring arrangement for use in a bore of a rock formation, it is not intended to be limited to the details shown, since various modifications and structural changes may be made without departing in any way from the spirit of the present invention.

Without further analysis, the foregoing will so fully reveal the gist of the present invention that others can, by applying current knowlwdge, readily adapt it for various applications without omitting features that, from, the standpoint of prior art, fairly constitute essential characteristics of the generic and specific aspects of our contribution to the art and, therefore, such adaptations should and are intended to be comprehended within the meaning and range of the equivalence of the claims.

What is claimed as new and desired to be protected by Letters Patent is set forth in the appended claims.

We claim:

1. An anchoring arrangement adapted to be inserted into and held by a body of hardenable material in a bore provided in a support structure, especially in a rock formation encountered in tunnel and mine construction, particularly such involving a considerable convergence, comprising a sleeve centered on an axis and having a leading end and a trailing end as considered in the direction of insertion thereof into the bore; a mounting plate arranged at said trailing end of said sleeve and adapted to contact the support structure around the bore; an elongated anchoring rod having a trailing end portion at least partially accommodated within said sleeve and having a predetermined cross-sectional area, a leading end portion of a smaller cross-sectional area than said trailing end portion extending beyond said leading end of said sleeve into the bore, and a transition region situated between said leading and trailing end portions, at least said trailing end portion and transition region being of a yieldable material; and at least one drawing die secured to said sleeve at said leading end and having an aperture of a cross-sectional configuration corresponding to that of said anchoring rod at said transition region, said drawing die deforming said yieldable material at said transition region when said sleeve and anchoring rod are subjected to opposite axial forces tending to pull said anchoring rod out of said sleeve, to achieve gradual drawing of said transition region and trailing end portion of said anchoring rod through said drawing die when the magnitude of said axial forces exceeds a predetermined level.

2. The arrangement as defined in claim 1, wherein said transition region of said anchoring rod slightly converges from the trailing to the leading end portion.

3. The arrangement as defined in claim 2, wherein the angle of convergence of said transition region is between 3° and 10° relative to the longitudinal axis of said anchoring rod.

4. The arrangement as defined in claim 3, wherein said angle of convergence is substantially 7°.

5. The arrangement as defined in claim 2, wherein said leading and trailing end portions of said anchoring rod are substantially cylindrical; and wherein said transition region is substantially frusto-conical.

6. The arrangement as defined in claim 1, wherein said aperture of said drawing die has at least two steps.

7. The arrangement as defined in claim 6, wherein said steps are constituted by alternatingly axially adjacent first sections which converge in the direction from the trailing to the leading end portion of said anchoring rod and second sections which are substantially centered on the axis of said anchoring rod.

8. The arrangement as defined in claim 7, wherein said first sections have the same angle of convergence.

9. The arrangement as defined in claim 1, wherein said drawing die includes at least two elements which are arranged axially adjacent to one another at said leading end of said sleeve and each having a section of said aperture which is stepped with respect to the section of said aperture provided in the other element.

10. The arrangement as defined in claim 1, wherein each of said section of said aperture in said elements includes a central first zone which converges in the direction from the trailing to the leading end portion of said anchoring rod, and two second zones axially flanking said first zone and substantially centered on the longitudinal axis of said anchoring rod.

11. The arrangement as defined in claim 1, wherein said leading end of said sleeve has an inwardly deformed portion which retains said drawing die within said sleeve.

12. The arrangement as defined in claim 11, and further comprising a seal at the region of said inwardly deformed portion of said sleeve.

13. The arrangement as defined in claim 12, wherein said seal is an annular sealing element of synthetic plastic material.

14. The arrangement as defined in claim 1, wherein said trailing end of said sleeve includes an end portion which is situated externally of the bore and which is outwardly upset substantially at a right angle to the axis of said sleeve.

15. The arrangement as defined in claim 14, wherein said outwardly upset end portion of said sleeve has edge surfaces which have an outline that is eccentric relative to the axis of said sleeve.

16. The arrangement as defined in claim 1, wherein said leading end portion of said anchoring rod has circumferential surfaces which have an outline which is eccentric relative to the extension of the longitudinal axis of said trailing end portion of said anchoring rod beyond said sleeve.

17. The arrangement as defined in claim 16, wherein said leading end portion of said anchoring rod has an undulating configuration in the axial direction of said trailing end portion at least in one plane.

18. The arrangement as defined in claim 17, wherein said leading end portion of said anchoring rod has at least one helical ridge at its outer circumference.

19. The arrangement as defined in claim 16, wherein said leading end portion of said anchoring rod has at least one helical ridge at its outer circumference.

20. The arrangement as defined in claim 1, wherein said leading end portion of said anchoring rod has an undulating configuration in the axial direction of said trailing end portion at least in one plane.

21. The arrangement as defined in claim 1, wherein said leading end portion of said anchoring rod has at least one helical ridge at its outer circumference.

* * * * *